US007967000B2

(12) United States Patent
Walker et al.

(10) Patent No.: US 7,967,000 B2
(45) Date of Patent: Jun. 28, 2011

(54) LOW PRESSURE PAINTBALL GUNS

(75) Inventors: Mark Andrew Walker, Staffordshire (GB); John Ronald Rice, Staffordshire (GB)

(73) Assignee: WDP Ltd. (GB)

( * ) Notice: Subject to any disclaimer, the term of this patent is extended or adjusted under 35 U.S.C. 154(b) by 223 days.

(21) Appl. No.: 12/327,435

(22) Filed: Dec. 3, 2008
(Under 37 CFR 1.47)

(65) Prior Publication Data

US 2009/0260610 A1 Oct. 22, 2009

Related U.S. Application Data

(60) Provisional application No. 61/005,461, filed on Dec. 4, 2007.

(51) Int. Cl.
*F41B 11/00* (2006.01)

(52) U.S. Cl. ..... 124/73; 124/75; 124/77

(58) Field of Classification Search ..... 124/73–77
See application file for complete search history.

(56) References Cited

U.S. PATENT DOCUMENTS

| | | | | |
|---|---|---|---|---|
| 5,503,549 | A * | 4/1996 | Iasella | 431/18 |
| 6,618,975 | B1 * | 9/2003 | Shih | 42/75.03 |
| 2003/0079731 | A1 * | 5/2003 | Dobbins | 124/76 |
| 2005/0115552 | A1 * | 6/2005 | Dobbins | 124/73 |
| 2005/0268894 | A1 * | 12/2005 | Styles et al. | 124/74 |
| 2007/0001139 | A1 * | 1/2007 | Fleischer et al. | 251/129.15 |
| 2007/0017497 | A1 * | 1/2007 | Masse | 124/73 |
| 2007/0131210 | A1 * | 6/2007 | Lai | 124/73 |
| 2007/0163563 | A1 * | 7/2007 | Gan | 124/73 |
| 2007/0295320 | A1 * | 12/2007 | Carnall et al. | 124/73 |
| 2009/0199834 | A1 * | 8/2009 | Skilling | 124/77 |
| 2009/0241931 | A1 * | 10/2009 | Masse | 124/76 |

* cited by examiner

*Primary Examiner* — Troy Chambers
*Assistant Examiner* — Samir Abdosh
(74) *Attorney, Agent, or Firm* — Foley & Lardner LLP

(57) ABSTRACT

A paintball gun comprises: a body defining a gas storage chamber for connection to a source of pressurized gas, a breech into which paintballs can be loaded, and a hammer chamber; a bolt slidable in the breech and having a bolt inlet port; a hammer slidable in the hammer chamber and connected to the bolt; and a poppet valve comprising a valve body defining a valve inlet connected to the storage chamber, a valve outlet connected to the breech, and a blow back port connecting the inlet to the hammer chamber, and a valve member slidable in the valve body and movable between an open position, in which it allows gas to flow from the storage chamber through the valve inlet to the valve outlet, and a closed position in which it closes the valve, and a pair of magnets arranged to bias the poppet towards the closed position.

11 Claims, 3 Drawing Sheets

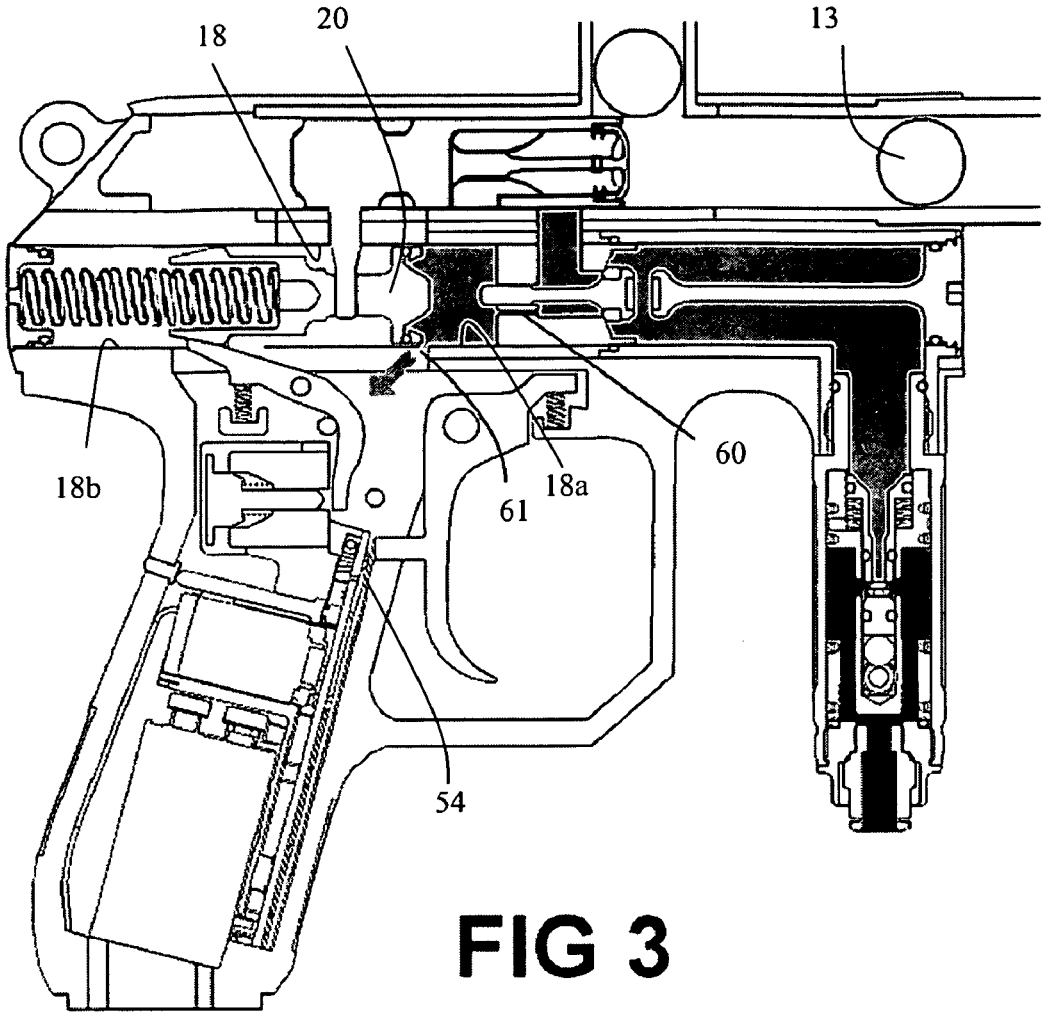
FIG 3
FIG 4
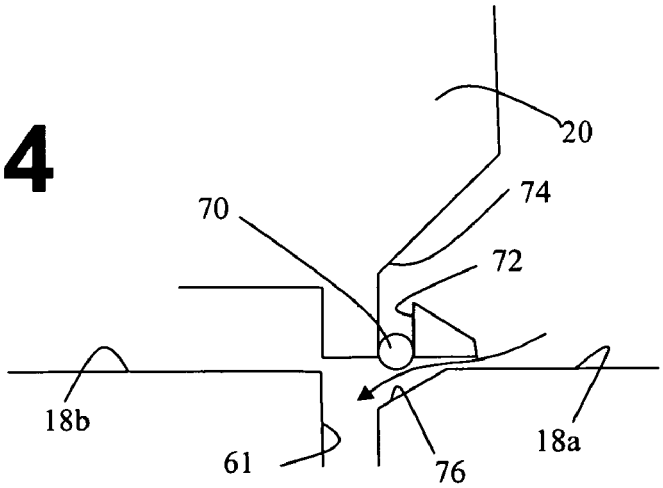

LOW PRESSURE PAINTBALL GUNS

CROSS-REFERENCE TO RELATED PATENT APPLICATIONS

This application claims priority from U.S. Provisional Patent Application No. 61/005,461 filed on Dec. 4, 2007 and is incorporated herein by reference in its entirety.

FIELD OF THE INVENTION

The present invention relates to paintball guns and in particular to paintball guns arranged to operate at relatively low gas pressure.

BACKGROUND OF THE INVENTION

Paintballs for use in paintball guns (also referred to as markers) are constructed from fragile materials that are designed to break on contact with a target.

Paintballs are fired from a marker by gas pressure acting as a propellant and therefore in the construction of a paintball a balance needs to be struck between ensuring that the paintball is strong enough to withstand the initial propellant gas pressure but fragile enough to fracture upon impact. It is therefore desirable to apply as little force as possible to the paintball from the gas pressure, while still imparting sufficient kinetic energy to the paintball. This has lead to the development of lower pressure paintball markers which in turn has also allowed the evolution of more fragile paintballs which, due to their increased fragility, disperse their kinetic energy better upon impact.

Some problems with this low pressure operation are that losses can become greater and the airflow becomes more critical as the speed of operation of the gas delivery system is still required to be fast but needs to achieve higher gas flows at lower pressures.

In blow back type paintball guns, a hammer is moved by a spring when the trigger is pulled and opens a valve to release the gas pressure which fires the paintball. The gas pressure which is used to fire the paintball is also used to push (or 'blow') the hammer back against the force of the spring to re-cock the gun.

SUMMARY OF THE INVENTION

The present invention provides a paintball gun comprising: a body defining a gas storage chamber for connection to a source of pressurized gas, a breech into which paintballs can be loaded, and a hammer chamber; a bolt slidable in the breech and having a bolt inlet port; a hammer slidable in the hammer chamber and connected to the bolt; and a poppet valve comprising a valve body defining a valve inlet connected to the storage chamber, a valve outlet connected to the breech, and a blow back port connecting the inlet to the hammer chamber, and a valve member slidable in the valve body and movable between an open position, in which it allows gas to flow from the storage chamber through the valve inlet to the valve outlet, and a closed position in which it closes the valve. The gun may further comprise a pair of magnets arranged to bias the poppet towards the closed position.

In some embodiments the valve member comprises a head projecting into the storage chamber and one of the magnets is mounted on the head. The body may define an opening at the front end of the storage chamber, and the gun may further comprise a cap which closes the opening. One of the magnets may be supported on the cap. For example, the gun may further comprise a support bar, which may project from the cap or be supported in some other way, and one of the magnets may be supported on the support bar.

In some embodiments the valve outlet has a greater cross sectional area than the valve inlet. For example the valve inlet and the valve outlet may each be formed as a bore or passage in the valve body. These may be of various cross sections. For example the inlet may have a circular cross section and the outlet may have an oval or other non-circular cross section.

In some embodiments the hammer comprises a hammer body having a circumferential groove around it, and a seal located in the groove. The hammer body may have a front end which faces the blow back chamber and a seal activation passage formed therein connecting the blow back chamber to the groove whereby gas can flow from the blow back chamber into the groove to urge the seal outwards to seal the blow back chamber.

The front end of the hammer may include a central impact region arranged to impact the valve member, and an outer region extending around the impact region. The seal activation passage may open into the outer region.

Some embodiments of the present invention can provide a very high flow poppet valve with assisted closure produced by magnets. Due to their very short working stroke and high load-to-stroke ratio, which is more controllable than a traditional spring, in conjunction with an exhaust port that has a larger surface area than the inlet port, reduction in back pressures and force can be provided, which can normally only be achieved by increasing the valve dwell opening time if sufficient amount of gas flow through the poppet valve is to be achieved.

The energy for firing the gun is in some embodiments provided by mechanical spring force and its re-cocking energy may be provided by pneumatic force. This cycle can be repeated whenever the gun is fired by means of releasing of a sear that is holding the spring force back. Traditionally blow back guns have to use a high force spring to overcome the force to open the valve but by use of the magnetic poppet valve this force can be greatly reduced allowing a lighter hammer to also be used which reduces the recoil energy. Traditionally blow back gas is very prone to large losses affecting the efficiency of the system. By the addition of an active seal on the hammer, in some embodiments of the invention, friction forces and losses are kept low as the hammer seal only becomes active during its return stroke, or indeed only a part of its return stroke, and does not offer any resistance and losses due to friction on its forward stroke, allowing all the energy from the spring to be imparted to the magnetic exhaust valve.

Preferred embodiments of the present invention will now be described by way of example only with reference to the accompanying drawings.

BRIEF DESCRIPTION OF THE DRAWINGS

FIG. 3 is a section through the paintball gun of FIG. 1 during blow-back; and FIG. 4 is an enlargement of part of the section of FIG. 3.

DETAILED DESCRIPTION OF THE PREFERRED EMBODIMENTS

Figure 1:
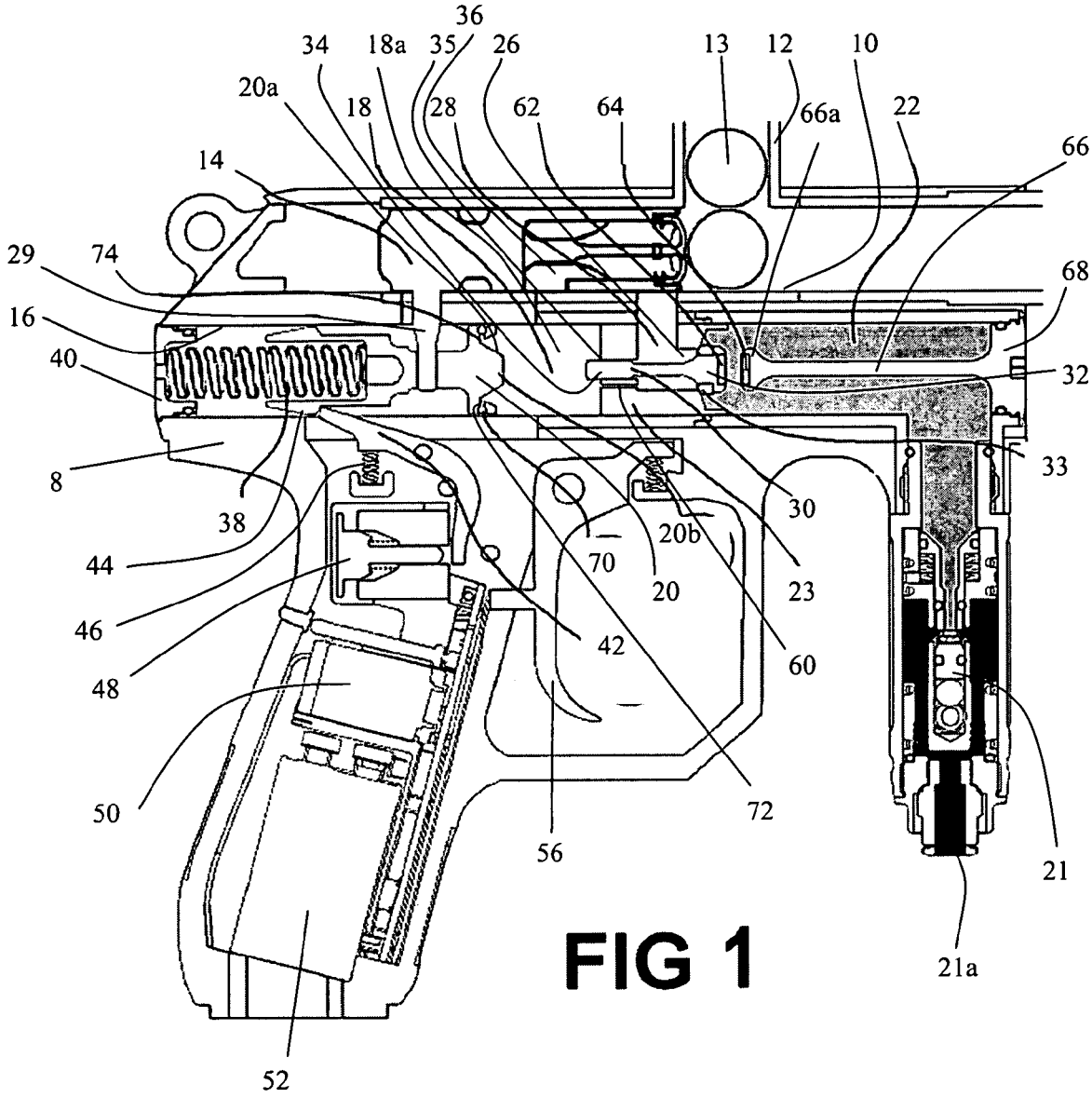
FIG. 1 is a section through a paintball gun according to an embodiment of the invention in a "cocked" position ready to fire.
Figure 2:
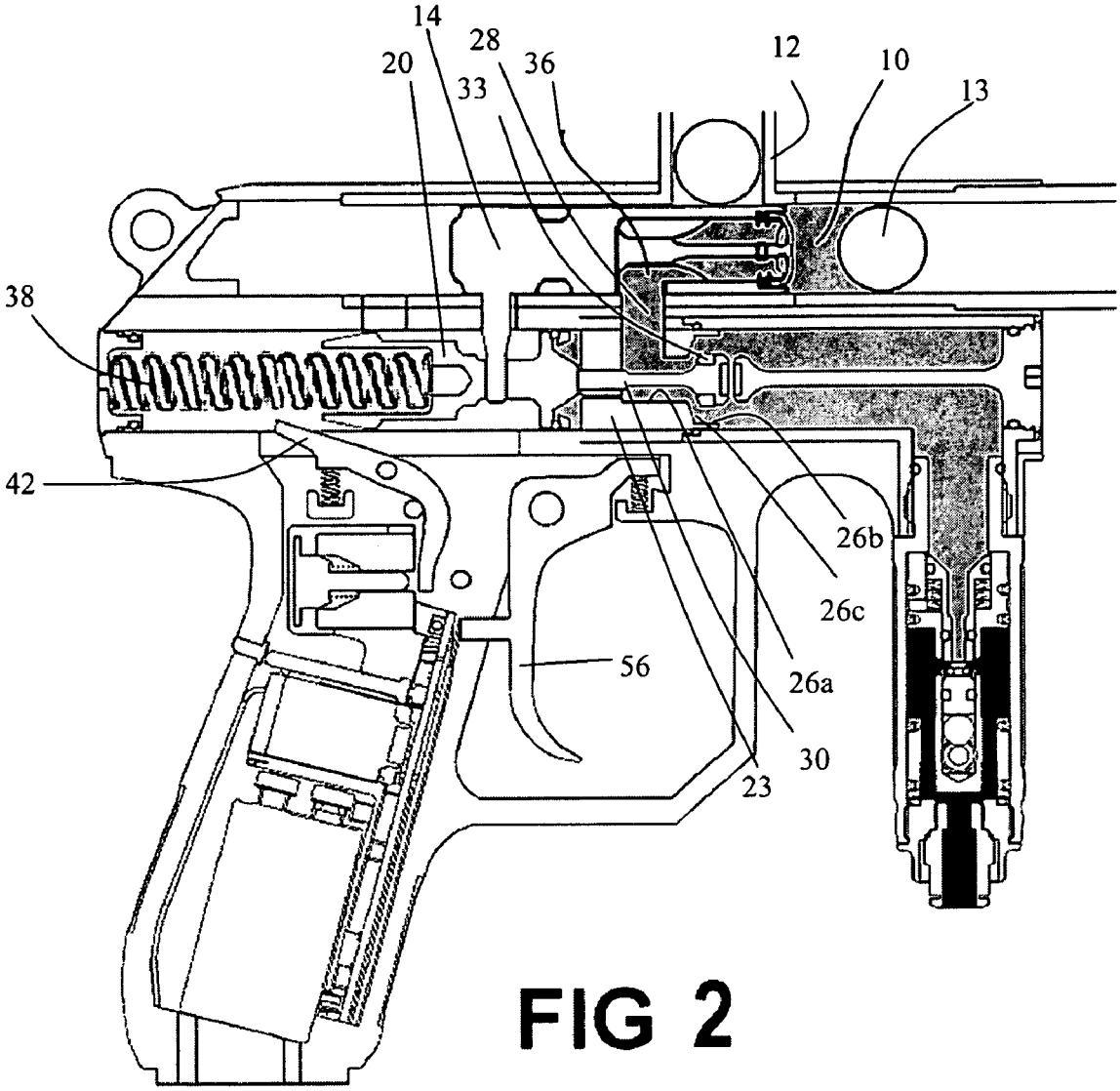
FIG. 2 is a section through the paintball gun of FIG. 1 in a fired state.

Referring to FIG. 1, a paintball gun comprises a gun body 8 with a tubular breech 10 formed in it with a paintball feed tube 12 opening into the breech through which paintballs 13 can be fed. A bolt 14 is located in the breech behind the feed tube 12 and is slidable backwards and forwards to load paintballs 13 into the breech 10 and fire them. A further cylindrical cavity 16 is formed in the gun body 8 below the breech 10 the rear part of which forms a hammer chamber 18 in which a hammer 20 is slidably located, and the front part of which forms a gas storage chamber 22. A poppet valve 23, 30 is located in the cavity 16 between the hammer chamber 18 and gas storage chamber 22, and comprises a valve body 23 having a gas inlet 26 and a gas outlet 28 formed in it, and a poppet 30. The gas inlet 26 opens into the gas storage chamber 22 and the gas outlet opens into the breech 10 just behind the paintball feed tube 12. The poppet 30 includes a head 32 which projects into the gas storage chamber 22 and is larger in diameter than the gas inlet 26, having a seal 33 arranged to seal against the gas inlet 26 to close it, and a stem or actuator 34 extending through the gas inlet 26 and out through a further aperture or bore 35 in the back of the valve body 23 into the hammer chamber 18. The poppet 30 is movable between a closed position, as shown in FIG. 1, in which the head 32 of the poppet 30 closes the end of the gas inlet 26 and the stem 34 of the poppet 30 projects from the rear of the valve body 23 into the hammer chamber 18, and an open position, as shown in FIG. 2, in which the poppet 30 is moved forwards so that its head 32 is clear of the gas inlet 26 to open the valve and allow gas to flow from the storage chamber 22 through the inlet 24 and the outlet 26 into the breech 10. The gas storage chamber 22 is connected via a pressure control valve 21 to a source 21*a* of pressurized gas, typically in the form of a canister.

The outlet port 28 is larger, having a larger effective cross sectional area, than the inlet port 26. The inlet port 26 is of circular cross section. The outlet port 28 is of an oval cross section which is wider in the transverse direction of the gun than in the longitudinal direction of the gun. However other cross sectional shapes can be used. The open or effective area of the inlet port 26 is further reduced by the presence of the poppet stem 34, and the poppet head 32, within the inlet port. The effective area of the inlet port is therefore the smallest cross sectional area, perpendicular to the flow of gas, between the poppet 30 and the valve body 23. In this embodiment the inlet port 26 is formed as a first passage in the form of a bore 26*a* extending in from the front end of the valve body 23, but with a wider bore 26*b* at its outer, forward, end, with a shoulder 26*c*, between the inner and outer bores 26*a*, 26*b*, the radially inner part of which forms the valve seat. The shoulder 26*c*, including the valve seat, is dished or concave with its outer edge further forward than its inner edge. When the valve is open, the head 32 of the poppet 30 is located within the wider outer bore 26*b*. The narrowest part of the inlet port is in this case between the valve seal 33 and the valve seat 26*c*, where the flow of gas has a radial as well as an axial component. The outlet port is formed as a second passage extending in from the top of the valve body 23 and opening into the side of the first passage. The bore 35 through which the poppet stem 34 projects is co-axial with, and of smaller diameter than, the inlet 26.

The hammer 20 is connected to the bolt 14 by a link 29 so that the two components slide backwards and forwards together. When they are in a cocked position, at the rear extreme of their travel as shown in FIG. 1, the hammer 20 is spaced from the valve poppet stem 34 and the front end of the bolt 14 is just behind the paintball feed tube 12, with the body of the bolt 14 sealing the gas outlet 28. When the bolt 14 and hammer 20 are in their forward 'fired' position, as shown in FIG. 2, the bolt 14 has moved past the feed tube 12 closing it off, the gas port 36 through the bolt 14 connects the gas outlet 28 to the breech 10 in front of the bolt 14, and the hammer 20 comes momentarily to rest just clear of the valve body 23 having pushed the poppet 30 forwards to open the valve.

A compression spring 38 acts between a cap 40 at the back of the hammer chamber 18 and the hammer 20 to bias the hammer 20 forwards towards its fired position. A sear 42 is pivotably mounted, for example on the gun body 8, and pivotable between an engaging position in which it engages a detent 44 on the hammer 20 to lock the hammer 20 in the cocked position and a release position in which it allows the hammer 20 to move forwards under the influence of the spring 38. The sear 42 is in turn biased into the engaging position by a return spring 46 and movable into the releasing position by an electromagnetically operated plunger 48. A control circuit 50 controls operation of the plunger 48, using power from a battery 52, using inputs from a switch 54 which is closed by the pulling of a trigger 56.

A blow back port 60 is formed in the valve body 23 between the gas inlet 26 and the front part of the hammer chamber 18 which forms a blow back chamber 18*a*. This allows gas to flow under pressure from the gas inlet 26 into the blow back chamber 18*a* after the hammer 20 has opened the valve. This gas pressure pushes the hammer 20 back against the force of the spring 38 to return it to its cocked position where the sear 42 latches it until the sear 42 is again released. It will be appreciated that the blow back port 60 can in other embodiments connect the gas inlet 26 indirectly to the blow back chamber 18*a*, for example opening into the outlet port 28 rather than the inlet port 26.

As can best be seen in FIG. 3 and FIG. 4, an exhaust port 61 is provided in the hammer chamber 18 and divides the hammer chamber 18 into the blow back chamber 18*a* at the front of the hammer chamber 18, and a rear part 18*b* at the rear of the hammer chamber. The exhaust port 61 is in front of the hammer 20 when the hammer 20 is in its fully retracted or cocked position. Just in front of the exhaust port 61, the outer wall of the blow back chamber 18*a* flares outwards forming a flared portion 76 of the chamber 18 which gets larger in cross sectional area towards the rear. The exhaust port 61 is located just to the rear of the widest part of the chamber 18. Behind the exhaust port 61, the rear part 18*b* of the hammer chamber 18 is again of constant cross section of equal diameter to the main part of the blow back chamber 18*a*. This allows the seal 70 to come clear of the chamber wall reducing friction, and then the gas pressure in the blow back chamber 18*a* to be released, after which the hammer 20 moves back under its own momentum until it reaches its cocked position. The exhaust port 61 is located between the forwardmost position of the seal 70, which the seal 70 occupies when the hammer 20 is fully forwards, and the rearmost position of the seal 70, which the seal 70 occupies when the hammer 20 is in its cocked position. This divides the rearward travel of the hammer 20 into two parts, the first during which the seal 70 is forward of the exhaust port 61 and the hammer 20 is pushed back by the gas pressure in the blow back chamber 18*a*, and the second part during which the seal 70 is behind the exhaust port 61 and the hammer 20 travels back under its own momentum after the pressure in the blow back chamber 18*a* has dropped due to the gas escaping through the exhaust chamber. The second part of this travel may be for example at least two thirds of the full travel of the hammer 20, or at least three quarters of its travel.

The valve poppet 30 is biased into its closed position be a pair of magnets 62, 64 which are arranged with like poles towards each other so that the magnets 62, 64 repel each other. One of the magnets 62 is located in the front of the poppet head 32 with its poles aligned in the axial direction of the poppet 30, and the other 64 is supported on a support bar 66, also with its poles aligned in the axial direction of the poppet 30. The support bar 66 extends axially along the centre of the storage chamber 22 and is mounted on a plug 68 which closes the front end of the gas storage chamber 22. In this embodiment the support bar 66 is formed integrally with the plug 68. The support bar 66 is of constant diameter over most of its length, but has a magnet support 66*a* at its free end which is of a wider diameter than the main part of the support bar 66. The stationary magnet 64 is positioned in the gas storage chamber 22, on the magnet support 66*a* at the rear end of the support bar 66, so that it is spaced from the magnet 62 in the poppet head 32 when the poppet valve is closed, and closer to but just spaced from the magnet 62 in the poppet head 32 when the poppet valve is fully open with the poppet 30 in its forward-most position.

It will be appreciated that the main volume of the storage chamber 22 around the support bar 66 is of approximately annular cross section. In this embodiment the outer wall of the storage chamber 22 is of circular cross section, but oval or other cross sections can also be used. The cross sectional area of the storage volume decreases in the region of the magnet support 66*a*, then decreases again in the region around the poppet head 32, before reaching its narrowest point as described above between the valve seal 33 and valve seat 26*c*. This gradual decrease in cross sectional area along an annular volume allows the gas to flow smoothly along the storage volume and into the valve inlet 26.

It will also be appreciated that the stationary magnet 64 could be supported in the same position in a number of different ways. For example in one embodiment the support bar 66 is a separate component from the plug 68, but still connected to it. In a different embodiment a moulded plastic support member can be placed in the storage chamber 22 and located in position by a number of radial supports which rest against the walls of the storage chamber 22, the magnet 64 being mounted on the support member. In a further embodiment, the stationary magnet 64 can be mounted on a support which is mounted on the valve body 23.

An O-ring seal 70 is located in a circumferential groove 72 around the hammer 20 to form a seal between the hammer 20 and the wall of the blow back chamber 18*a*. The outer diameter of the O-ring in its relaxed state is slightly less than the inner diameter of the hammer chamber 18 so that, when it is relaxed, the O-ring does not seal against the chamber 18. A number of passages 74 are formed in the hammer 20 between its front end 20*a* and the bottom of the groove 72. These passages 74 open close to the radially outer edge of the front end 20*a* of the hammer 20, so that there is a solid impact region 20*b* at the centre of the front end of the hammer 20 which is arranged to impact against the valve poppet stem 34. When pressurized gas is present in the blow back chamber 18*a* in front of the hammer 20 this passes through the passages 74 and acts on the inside of the O-ring seal 70 to push it outwards so that it seals against the hammer chamber 18.

In operation, actuation of the hammer 20 is by the compression spring 38. When the hammer 20 is cocked ready for firing it is retained by the sear 42, which is waiting to be operated under the control of the control circuit in response to pulling the trigger 56. FIG. 1 shows the mechanism in the ready to fire condition with the poppet valve in the closed position with the poppet seal 33 closed against the valve body 23 preventing gas from the storage chamber 22 being released into the gas inlet 26 or exhaust chamber 28.

The poppet 30 is biased into the closed position by gas pressure acting upon it from the storage chamber 22 and the bias force from the two repelling magnets 62, 64 that have like poles facing each other applying magnetic force to assist in retaining closure of the poppet valve seal 33 against the valve body 23. The sear 42 can in other embodiments be operated mechanically, by operation of the trigger 56.

Referring to FIG. 2, activation of the trigger 56 releases the sear 42 from its 'cocked' state. The hammer 20 travels forward due to the force of the spring 38 acting from behind. Until the hammer 20 strikes the poppet stem 34, the poppet valve is still in the closed position with the poppet seal 33 closed against the valve body 23 preventing gas from the storage chamber 22 being released through the gas inlet 26. The hammer seal 70 is in the seated position in the bottom of the groove 72 in the hammer 20, and is not in contact with the wall of hammer chamber 18, and is therefore exerting no resistance or generating losses due to friction, and hence does not act as a pneumatic damper due to a piston effect.

FIG. 2 shows the mechanism in the fired condition with the hammer 20 having struck the poppet stem 34 and shows the poppet valve in the open position with the seal 33 lifted off the valve body 23 allowing gas to enter the gas inlet 26.

The spring biased hammer 20 that was released by the sear 42 is connected via the mechanical linkage 29 to the loading bolt 14 which also moves forwards with the hammer 20 and pushes a paintball 13 into the breech and aligns the inlet of the gas port 36 in the bolt 14 with the valve outlet port 28. The poppet 30, which is biased into the open position by kinetic energy from the hammer 20 striking the poppet valve actuator stem 34 allows gas stored in the storage chamber 22 to be released into the valve inlet 26 and outlet 28 and through the gas port 36 in the bolt 14 to exit the bolt 14 to propel the paintball 13. As the gas enters the valve body 23 a controlled amount is also allowed to exit via the blow back port 60 (this can be a single port or a number of ports). This gas raises the pressure in the blow back chamber 18*a* in front of the hammer 20 and passes through the ports 74 into the bottom of the groove 72 where it acts on the seal 70 urging it outwards to seal against the wall of the blow back chamber 18*a*. The gas is therefore allowed to act on this elastomeric seal 70 on its back face and this gas expands the seal 70 in its groove 72 so that it generates a gas seal with the chamber wall. This prevents the escape of the gas released from the poppet valve through the port 60, keeping the pressure within the blow back chamber 18*a* and preventing loss of gas pressure while the hammer 20 is moving back. This seal 70 is non-contacting with the chamber wall whilst the hammer 20 moves forward and offers no resistance or losses due to friction and does not act as a pneumatic damper due to a piston effect which can otherwise occur.

Referring to FIGS. 3 and 4, during blow back, the gas pressure in the blow back chamber 18*a* acts upon the hammer 20, forcing it back to compress the spring 38. As it moves back, the momentum of the hammer 20 will cause it to return and latch against the sear 42. Before it reaches that stage, the seal 70 first reaches the flared chamber region 76 so that friction between the seal 70 and the chamber 18*a* falls off reducing the resistance to backward movement of the hammer 20 and allowing gas in the blow back chamber 18*a* to start to escape from the exhaust port 61. Then the hammer 20 moves clear of the exhaust port 61 fully opening it and allowing the gas pressure in the blow back chamber 18*a* to be released via the exhaust port 61, and the gas to escape to atmosphere. This causes the pressure within the blow back chamber 18*a* to collapse which in turn collapses the pressure that was holding the hammer seal 70 out against the chamber wall. This allows the seal 70 to return to its seated position so that it is no longer in contact with the chamber wall, in the rear part 18*b* of the hammer chamber 18, allowing the momentum of the hammer 20 to finalize its return stroke.

The bolt 14 is also returning during this stage of the cycle, and once fully returned will allow another paintball 13 to fall into the firing position. Once the hammer 20 is in its return stroke the exhaust valve poppet 30 no longer has a mechanical force upon it and the magnets 62, 64 can act independently of the hammer 20 and allow the magnetic repulsion forces to close the valve and seal the seal 33 against the valve body 23 preventing any further release of gas from the storage chamber 22 into the exhaust valve body 23.

It will be appreciated that embodiments of the invention can be different from the one described above. For example in one embodiment the active hammer seal is present, but the poppet valve has a conventional spring rather than the magnetic spring.

The large cross section of the poppet valve outlet 28 has the advantage that gas can flow rapidly from the storage chamber to the breech with less loss of speed, and therefore energy, than with conventional valve designs. This enables the gun to operate efficiently even at low gas pressure. The active seal 70 on the hammer 20 also helps to reduce loss of gas to atmosphere during operation of the gun. The advantage of using a magnetic valve is that the force drops off very rapidly as the magnets 62, 64 move apart on closure of the valve. Therefore when the valve is closed, it is held closed mostly by the gas pressure in the storage chamber, and the magnets 62, 64 do not add significantly to the closure force. This means that the force required to open the valve is less than with a standard compression spring. Therefore, by using the gas efficient high flow magnetic poppet valve in conjunction with the hammer 20 with an active return stroke seal 70 on it, it allows a lower initial storage chamber pressure in the storage chamber 22, in turn resulting in a lower hammer mass, and a lower spring force required to open the valve. Overall this system means that there will be a reduced recoil force (or 'kick') experienced by the player, and the system will be more gas efficient than known blowback marker design.

What is claimed is:

1. A paintball gun comprising:

a body defining a gas storage chamber for connection to a source of pressurized gas, a breech into which paintballs can be loaded, and a hammer chamber;

a bolt slidable in the breech and having a bolt inlet port;

a hammer slidable in the hammer chamber and connected to the bolt;

and a poppet valve comprising a valve body defining a valve inlet connected to the gas storage chamber, a valve outlet connected to the breech, and a blow back port connecting the valve inlet to the hammer chamber, and a valve member slidable in the valve body and movable between an open position, in which it allows gas to flow from the gas storage chamber through the valve inlet to the valve outlet, and a closed position in which it closes the poppet valve and the valve member comprising a head projecting into the gas storage chamber and one of a pair of magnets being mounted on the head; and the pair of magnets arranged to bias the poppet valve towards the closed position.

2. A paintball gun according to claim 1 wherein the body defines an opening at the front end of the gas storage chamber, and the gun further comprises a cap which closes the opening, and one of the pair of magnets is supported on the cap.

3. A paintball gun according to claim 2 further comprising a support bar projecting from the cap, wherein one of the pair of magnets is supported on the support bar.

4. A paintball gun according to claim 1 wherein the hammer comprises a hammer body having a circumferential groove around it, and a seal located in the groove, wherein the hammer chamber includes a front portion adjacent to the valve body that forms a blow back chamber, and the hammer body has a front end which faces the valve body and a seal activation passage formed therein for connecting the blow back chamber to the groove whereby gas can flow from the blow back chamber into the groove to urge the seal outwards to seal the blow back chamber.

5. A paintball gun according to claim 4 wherein the front end of the hammer includes a central impact region arranged to impact the valve member, and an outer region extending around the central impact region, wherein the seal activation passage opens into the outer region.

6. A paintball gun according to claim 5 wherein the hammer body has a plurality of seal activation passages therein spaced around the central impact region.

7. A paintball gun comprising:

a body defining a gas storage chamber for connection to a source of pressurized gas, a breech into which paintballs can be loaded, and a hammer chamber;

a bolt slidable in the breech and having a bolt inlet port;

a hammer slidable in the hammer chamber and connected to the bolt;

and a poppet valve comprising a valve body defining a valve inlet connected to the gas storage chamber, a valve outlet connected to the breech, and a blow back port connecting the valve inlet to the hammer chamber, and a valve member slidable in the valve body and movable between an open position, in which it allows gas to flow from the gas storage chamber through the valve inlet to the valve outlet, and a closed position in which it closes the poppet valve;

wherein the hammer comprises a hammer body having a circumferential groove around it, and a seal located in the groove, wherein the hammer chamber includes a front portion adjacent to the valve body that forms a blow back chamber, and the hammer body has a front end which faces the valve body and a seal activation passage formed therein for connecting the blow back chamber to the groove whereby gas can flow from the blow back chamber into the groove to urge the seal outwards to seal the blow back chamber.

8. A paintball gun according to claim 7 wherein the front end of the hammer includes a central impact region arranged to impact the valve member, and an outer region extending around the central impact region, wherein the seal activation passage opens into the outer region.

9. A paintball gun according to claim 8 wherein the hammer body has a plurality of seal activation passages therein spaced around the central impact region.

10. A paintball gun according to claim 7 wherein the seal has a fully forward position and a fully retracted position in which it is located when the hammer is fully forward and fully retracted respectively, and the hammer chamber has an exhaust port therein between the fully forward position and the fully retracted position so that, as the hammer moves towards is fully retracted position, the exhaust port is opened to allow gas to escape from the blow back chamber.

11. A paintball gun according to claim 10 wherein the hammer chamber has region of increased diameter forward of the exhaust port whereby friction between the seal and the hammer chamber is arranged to reduce before the seal reaches the exhaust port.

* * * * *